US008070020B2

(12) United States Patent
McGuffey et al.

(10) Patent No.: US 8,070,020 B2
(45) Date of Patent: Dec. 6, 2011

(54) REMOTE HOT MELT ADHESIVE METERING STATION

(75) Inventors: Grant McGuffey, Springfield, TN (US); Mel Steven Lesley, Villia Hills, KY (US); Daniel D. Bourget, Hendersonville, TN (US)

(73) Assignee: Illinois Tool Works Inc., Glenview, IL (US)

( * ) Notice: Subject to any disclaimer, the term of this patent is extended or adjusted under 35 U.S.C. 154(b) by 104 days.

(21) Appl. No.: 12/083,309

(22) PCT Filed: Sep. 18, 2006

(86) PCT No.: PCT/US2006/036168

§ 371 (c)(1),
(2), (4) Date: Jan. 26, 2009

(87) PCT Pub. No.: WO2007/046994

PCT Pub. Date: Apr. 26, 2007

(65) Prior Publication Data

US 2009/0214372 A1 Aug. 27, 2009

(51) Int. Cl.
*B67D 7/70* (2010.01)

(52) U.S. Cl. ..... 222/255; 222/146.2; 222/330; 222/333; 137/884

(58) Field of Classification Search ..... 222/146.1, 222/130, 146.2, 132, 146.5, 135, 330, 504, 222/333, 255, 272; 418/9, 15; 137/884
See application file for complete search history.

(56) References Cited

U.S. PATENT DOCUMENTS 3,179,382 A 4/1965 Knedlick
3,981,416 A * 9/1976 Scholl ..... 222/146.1
4,328,387 A * 5/1982 Kemble ..... 219/517
4,485,941 A * 12/1984 Frates et al. ..... 222/146.5
4,485,942 A * 12/1984 Petrecca ..... 222/146.5
4,667,850 A * 5/1987 Scholl et al. ..... 222/23
4,771,920 A * 9/1988 Boccagno et al. ..... 222/146.5
5,875,922 A * 3/1999 Chastine et al. ..... 222/1
5,927,555 A * 7/1999 Harben et al. ..... 222/146.5
6,089,413 A 7/2000 Riney et al.

(Continued)

FOREIGN PATENT DOCUMENTS

DE 1803549 12/1969

(Continued)

*Primary Examiner* — Frederick C. Nicolas
(74) *Attorney, Agent, or Firm* — Law Offices of Steven W. Weinrieb

(57) ABSTRACT

A new and improved remote, hot melt adhesive metering station (510), for supplying predetermined or precisely metered volumes of hot melt adhesive material toward applicator head or dispensing nozzle structures, comprises a plurality of rotary, gear-type metering pumps (518) which are arranged in a compact, longitudinally spaced manner upon an axially elongated drive gear manifold (512) such that the rotational axes of the plurality of rotary, gear-type metering pumps (518) are disposed parallel and adjacent to one side of the axially elongated drive gear manifold (512). Hot melt adhesive material is supplied from a remotely located adhesive supply unit (ASU), to the drive gear manifold (512), by an inlet supply port hose connection (542), and all of the pump driven gears (524) of the plurality of rotary, gear-type metering pumps (518) are respectively driven by manifold pump drive gears (514) which are all rotatably mounted upon a common, motor-driven drive shaft (516) rotatably disposed within the drive gear manifold (512). The drive gear manifold (512) is also provided with a plurality of outlet port hose connections (540) to which hot melt adhesive delivery hoses are to be connected.

12 Claims, 5 Drawing Sheets

U.S. PATENT DOCUMENTS

| | | | | |
|---|---|---|---|---|
| 6,171,089 | B1 | 1/2001 | Oehman, Jr. | |
| 6,422,428 | B1 | 7/2002 | Allen et al. | |
| 6,433,315 | B2 * | 8/2002 | Reifenberger et al. | 219/421 |
| 6,688,498 | B1 | 2/2004 | McGuffey | |
| 6,883,684 | B2 * | 4/2005 | Jeter et al. | 222/146.2 |
| 7,032,789 | B2 * | 4/2006 | Gabryszewski | 222/504 |
| 7,316,331 | B2 * | 1/2008 | Gabryszewski | 222/146.5 |
| 2004/0099752 | A1 | 5/2004 | Boger | |

FOREIGN PATENT DOCUMENTS

| | | |
|---|---|---|
| DE | 19615725 | 10/1997 |
| EP | 0819477 | 1/1998 |
| EP | 1316368 | 6/2003 |
| WO | WO 99/54055 | 10/1999 |
| WO | WO9954055 | 10/1999 |

* cited by examiner

REMOTE HOT MELT ADHESIVE METERING STATION

FIELD OF THE INVENTION

The present invention relates generally to hot melt adhesive dispensing systems, and more particularly to a new and improved remote hot melt adhesive metering station for supplying predetermined or precisely metered volumes of hot melt adhesive material toward applicator head or dispensing nozzle structures, wherein the new and improved remote hot melt adhesive metering station comprises a plurality of rotary, gear-type metering pumps which are arranged in a compact, longitudinally spaced manner upon a drive gear manifold such that the rotational axes of the plurality of rotary, gear-type metering pumps are disposed parallel and adjacent to one side of the drive gear manifold, wherein all of the driven gears of the rotary, gear-type metering pumps are respectively driven by pump drive gears which are rotatably mounted upon a common motor-driven drive shaft, and wherein the drive gear manifold is provided with a plurality of hose connections to which hot melt adhesive delivery hoses are to be connected so as to respectively conduct or convey the precisely metered amounts of the hot melt adhesive material, outputted by means of the plurality of rotary, gear-type metering pumps mounted upon the drive gear manifold, toward the applicator heads or dispensing nozzles.

BACKGROUND OF THE INVENTION

In connection with liquid dispensing assemblies, and more particularly, in connection with liquid dispensing assemblies which are being used to dispense hot melt adhesives or other thermoplastic materials, a typical dispensing assembly conventionally comprises a supply source of the adhesive or thermoplastic material, and means for precisely or accurately metering and pumping the adhesive or thermoplastic material toward an applicator head or dispensing assembly. In connection with particular applications or procedures, it is necessary to accurately or precisely meter the liquids being dispensed so as to ensure that a specific or predetermined volume of the liquid is in fact dispensed within a specific or predetermined period of time. For example, in connection with the dispensing of hot melt adhesive materials, it is often necessary to provide a plurality of individual pumps for providing predetermined volumes of the adhesive material, which may in fact comprise similar or different volume quantities or amounts, to discrete, separate, or respective applicator or dispensing outlets. The individual pumps conventionally comprise rotary gear pumps which are operatively connected to a drive motor through means of a common rotary drive shaft, and dynamic seals, that is, stationary seals which are operatively disposed around or operatively associated with the rotary drive shaft, are provided for effectively preventing any external or outward leakage of the hot melt adhesive material from the assembly at the interfaces defined between the rotary drive shaft and the rotatably driven gears of the rotary gear pumps. An example of such a conventional or PRIOR ART hot melt adhesive rotary gear pump assembly is disclosed, for example, within U.S. Pat. No. 6,422,428 which issued to Allen et al. on Jul. 23, 2002.

More particularly, as disclosed within FIG. 1, which corresponds substantially to FIG. 3 of the aforenoted patent to Allen et al., one of a plurality of gear pump assemblies, as utilized within a hot melt adhesive applicator assembly, is disclosed at 20, and it is seen that each gear pump assembly 20 comprises a conventional sandwiched construction comprising three plates 220,222,224 encompassing or enclosing a pair of gears 230,232. Gear 230 comprises an idler gear, whereas gear 232 comprises a driven gear which is operatively mounted upon a rotary drive shaft 234. The rotary drive shaft 234 has a hexagonal cross-sectional configuration so as to effectively define or provide the drive connection with the driven gear 232, and it is noted that the drive shaft 234 extends through each one of the gear pump assemblies 20. A pair of seals 240, only one of which is shown in FIG. 1, are provided within suitable apertures defined within the end plates 220, 224 so as to annularly surround the rotary drive shaft 234 and thereby prevent any leakage of the hot melt adhesive material out from the gear pump assembly 20. A threaded port 244 is provided for receiving a temperature sensor for ensuring that each gear pump assembly 20 has been heated to a predetermined temperature level prior to operation, and a rupture disk assembly 242 is provided for pressure relief under overpressure conditions. A bore 248 is provided for receiving a pressure transducer which can read output liquid pressure, and when the pressure transducer is not being utilized, a plug assembly 250 is adapted to be disposed within the bore 248.

While a gear pump assembly 20 such as that disclosed within the aforenoted patent to Allen et al. is operatively viable, the gear pump assembly 20 of the aforenoted type nevertheless exhibits several operative drawbacks and disadvantages. Firstly, for example, it is noted that in view of the fact that the seals 240 of the gear pump assembly 20 are located upon external surface portions of the end plates 220, 224 of the gear pump assembly 20, should the seals 240 experience failure, external leakage of the hot melt adhesive material poses obvious maintenance problems, not to mention the likelihood of the leaking hot melt adhesive material causing fouling of other operative components of the gear pump assembly 20. In addition, it has been noted in the aforenoted patent to Allen et al. that the rotary drive shaft 234 extends through each one of the gear pump assemblies 20. Accordingly, if, for example, one of the gear pump assemblies 20 should experience failure or exhibit leakage, and therefore needs to be removed for repair or replacement, the particular gear pump assembly 20 cannot in fact simply be removed from the overall hot melt adhesive dispensing assembly comprising the plurality of gear pump assemblies 20. To the contrary, and more particularly, the rotary drive shaft 234 must firstly be removed so as to subsequently permit the particular gear pump assembly 20 to be removed and separated from the other gear pump assemblies 20 in order to repair or replace the failed or leaking gear pump assembly 20. Upon completion of the repair or replacement of the failed or leaking gear pump assembly 20, the repaired gear pump assembly 20, or the new gear pump assembly 20, can effectively be re-inserted into the bank or array of gear pump assemblies 20 whereupon, still further, the rotary drive shaft 234 can be re-installed in connection with the plurality of rotary gear pump assemblies 20 so as to again be operatively engaged with each one of the plurality of rotary gear pump assemblies 20. Still yet further, if one of the gear pump assemblies 20 should experience failure and effectively become frozen, the failed and frozen gear pump assembly 20 will effectively prevent rotation of the rotary drive shaft 234 whereby the failed or frozen gear pump assembly 20 can experience or undergo further damage, and in turn, cause opeerative freezing or failure of the other gear pump assemblies 20 which are rotatably engaged with and driven by means of the common rotary drive shaft 234.

Accordingly, a need existed in the art for a new and improved gear pump assembly for use in connection with liquid dispensing assemblies wherein the liquid dispensing assembly would comprise a plurality of rotary, gear-type pump assemblies which are mounted upon the liquid dispensing assembly such that all of the gear pump assemblies would be independent with respect to each other, wherein the plurality of rotary, gear-type pump assemblies would be operatively driven by means of a common rotary drive shaft in such a manner that no external dynamic seals would be required, wherein any particular one of the rotary, gear-type pump assemblies could be readily removed from the array or bank of rotary, gear-type pump assemblies independently of the other rotary, gear-type pump assemblies, and subsequently be re-inserted into the array or bank of rotary, gear-type pump assemblies, or replaced by means of a new rotary, gear-type pump assembly, and wherein still further, as a result of the plurality of rotary, gear-type pump assemblies being independent with respect to each other and not being operatively driven by means of, or mounted upon, a common internally disposed rotary drive shaft, then should a particular one of the rotary, gear-type pump assemblies experience a failure, the failed rotary, gear-type pump assembly would not experience additional damage or cause the other rotary, gear-type pump assemblies to experience freezing or failure. The aforenoted need in the art was addressed by means of the rotary, gear-type pump assemblies disclosed U.S. Pat. No. 6,688,498 which issued to McGuffey on Feb. 10, 2004, which patent is hereby incorporated herein by reference.

More particularly, as disclosed within FIG. 2, which corresponds substantially to FIG. 4 of the aforenoted patent to McGuffey, it is seen that each one of the rotary, gear-type pump assemblies 310 comprises a housing defined by means of a sandwiched construction which includes an intermediate or central plate 316. The central or intermediate plate 316 is provided with a plurality of cutout regions 318, 320,322, and a plurality of gear members 324,326,328 are respectively rotatably disposed within the cutout regions 318, 320,322 such that the three gear members 324,326,328 are disposed in a substantially coplanar manner with respect to the central or intermediate plate 316. Gear member 324 comprises a pump driven gear, gear member 326 comprises a pump drive gear which is operatively enmeshed with the pump driven gear 324, and gear member 328 comprises a pump idler gear which is operatively enmeshed with the pump drive gear 326. Each one of the gear members 324,326,328 is respectively fixedly mounted upon a pin, axle, or shaft member 330, and opposite ends of the gear pins, axles, or shafts 330 are rotatably disposed within bearing members which, while not being shown within FIG. 2, are fully disclosed and illustrated within the aforenoted patent to McGuffey. The bearing members, not shown, are, in turn, disposed within recesses which are defined within or upon interior side surface portions of the side plates of the housing sandwich structure.

In this manner, the gear members 324,326,328 are effectively rotatably mounted internally within the housing sandwich structure. This particular structural arrangement, by means of which the gear members 324,326,328 are mounted upon the side plates of the rotary, gear-type pump assembly 310, is one of the critically important, and unique and novel, features characteristic of the rotary, gear-type pump assembly 310, as constructed in accordance with the principles and teachings of the invention as set forth in the aforenoted patent to McGuffey, and which will likewise play a critically important inventive role in connection with the present invention as will be set forth hereinafter. More particularly, it is noted that all of the rotary shafts 330 and the bearing members, not shown, are disposed in an entirely enclosed or encased manner within the internal confines of the sandwiched plate construction comprising the housing of the rotary, gear-type pump assembly 310. Viewed from a different point of view, none of the rotary shafts 330 and bearing members, not shown, project outwardly through, or extend externally of, the side plates of the gear pump housing, and in this manner, the need for external dynamic shaft seals, which have often conventionally proven to be sources of external leakage of the fluid being pumped and dispensed by means of the rotary, gear-type pump assembly 310, has effectively been eliminated or obviated. It is noted further that in order to fixedly secure together the plate members comprising the sandwiched construction of the housing of the rotary, gear-type pump assembly 310, as well as to ensure the proper coaxial alignment of the bearing member recesses defined within the side plates of the gear pump housing, with respect to the cutout regions 318,320,322, defined within the central or intermediate plate 316, so as to properly house, accommodate, and mount the three gear members 324,326,328, and their associated shafts 330 and bearing members, not shown, upon the plate members of the rotary, gear-type pump assembly 310, a plurality of screws and alignment pins extend through suitable bores, not numbered for clarity purposes, which are defined within the plate members of the rotary, gear-type pump assembly 310 as can be seen in connection with central or intermediate plate 316.

With reference continuing to be made to FIG. 2, and as will be more fully appreciated hereinafter, each one of the pump driven gears 324 of each one of the rotary, gear-type pump assemblies 310 is adapted to be drivingly enmeshed with a manifold pump drive gear, not shown within FIG. 2 but fully disclosed and illustrated within the aforenoted patent to McGuffey, wherein the plurality of manifold pump drive gears are drivingly or rotatably mounted upon a common drive shaft which extends axially through a drive gear manifold, also not shown within FIG. 2 but fully disclosed and illustrated within the aforenoted patent to McGuffey. The drive shaft, for rotatably driving all of the manifold pump drive gears, is adapted to be driven by means of a suitable drive motor and gearbox assembly, also not shown within FIG. 2 but fully disclosed and illustrated within the aforenoted patent to McGuffey, and the hot melt adhesive material, to be metered and dispensed by means of each one of the rotary, gear-type pump assemblies 310, is introduced into the drive gear manifold by means of a liquid inlet support port to which a suitable supply hose is connected so as to conduct hot melt adhesive material thereinto from an external or remote adhesive supply unit (ASU).

When the hot melt adhesive material is introduced into the drive gear manifold, the hot melt adhesive material will enter liquid supply cavities which are respectively defined around each one of the manifold pump drive gears, and each one of the liquid supply cavities is, in turn, respectively fluidically connected to a liquid accumulator cavity which is located at the enmeshed interface defined between each one of the manifold pump drive gears and the pump driven gears 324 of a particular one of the rotary, gear-type pump assemblies 310. As is apparent from FIG. 2, while a first arcuate portion of each pump driven gear 324 is drivingly enmeshed with its respective pump drive gear 326, a second arcuate portion of each pump driven gear 324 projects radially outwardly through an end face 402 of the central or intermediate plate 316 of each one of the rotary, gear-type pump assemblies 310 so as to be drivingly enmeshed with a respective one of the manifold pump drive gears. Accordingly, as the drive motor and gearbox assembly, not shown within FIG. 2 but fully disclosed and illustrated within the aforenoted patent to McGuffey, causes rotation of the common drive shaft, and therefore rotation of each one of the manifold pump drive gears, in the counterclockwise direction, the pump driven gear 324 of each one of the rotary, gear-type pump assemblies 310 will be driven in the clockwise direction CW, each one of the pump drive gears 326 will be driven in the counterclockwise direction CCW, and each one of the pump idler gears 328 will be driven in the clockwise direction CW, as viewed in FIG. 2. As can additionally be seen from FIG. 2, the diametrical extent of the cutout region 318 defined within the central or intermediate plate 316 of each one of the rotary, gear-type pump assemblies 310 is substantially larger than the diametrical extent of the pump driven gear 324 of each one of the rotary, gear-type pump assemblies 310.

Therefore, when the liquid, that is, the hot melt adhesive, which is to be pumped through the rotary, gear-type pump assembly 310 and ultimately dispensed from the dispensing assembly, not shown in FIG. 2, is supplied to each one of the aforenoted liquid supply cavities and each one of the liquid accumulator cavities, oppositely oriented liquid flow paths 404,406 are effectively defined between the inner peripheral wall of cutout region 318 and the outer periphery of the pump driven gear 324 despite the fact that the driven gear 324 is being driven in the clockwise direction CW. Subsequently, the liquid portions, originally flowing along the flow paths 404,406, are respectively entrained by means of each pump drive gear 326 and each pump idler gear 328 and conducted toward a common liquid inlet cavity 408 which is effectively formed adjacent to the interface defined between the cutout regions 320,322 that are formed within each central or intermediate plate 316 of each rotary, gear-type pump assembly 310 as may be appreciated from FIG. 2. Ultimately, the hot melt adhesive is, in turn, conducted from the common liquid inlet cavity 408 to control valve assemblies and dispensing nozzles or applicator heads by means of suitable fluid passageways defined within each one of the rotary, gear-type pump assemblies 310 and the drive gear manifold.

While the aforenoted gear pump assemblies of McGuffey were disclosed within the aforenoted U.S. Pat. No. 6,688,498 as being utilized in an integral manner with a hot melt adhesive applicator head or dispensing assembly as a result of, for example, being mounted directly upon the applicator head or dispensing assembly, circumstances may arise when it is not possible or practical to utilize such rotary, gear-type pump assemblies in an integral manner with a hot melt adhesive applicator head or dispensing assembly. One possible instance may be, for example, wherein all of the applicator heads or dispensing nozzles are not disposed at one location. In this instance, the applicator heads or dispensing nozzles are to be fluidically connected to the aforenoted rotary, gear-type pump assemblies by means of suitable hose structures for conveying the hot melt adhesive material from the plurality of rotary, gear-type metering pumps to the applicator heads or dispensing nozzles, however, it is undesirable that such hose structures have substantially large or elongated lengths in that predeterminedly desired pressure levels, and precisely metered or predetermined volumes of the hot melt adhesive material, are difficult to attain and maintain within such hose structures when the hose structures comprise substantial or significant length dimensions. It is therefore desirable to develop a metering station which can effectively be located remotely from a source or supply of the hot melt adhesive material, and wherein further, the hot melt adhesive metering station can then be fluidically connected to the applicator heads or dispensing nozzles by means of relatively short hose structures. In this manner, predeterminedly desired pressure levels, and precisely metered or predetermined volumes of the hot melt adhesive material, can be achieved and maintained such that precisely metered or predetermined volumes of hot melt adhesive material can in fact be dispensed onto predetermined substrate locations.

A need therefore exists in the art for a new and improved remote hot melt adhesive metering station wherein the hot melt adhesive metering station can effectively be located, for example, at a predetermined remote distance from a supply or source of the hot melt adhesive material, that is, an adhesive supply unit (ASU), wherein the remote hot melt adhesive metering station has a compact structure such that a multitude of rotary, gear-type metering pumps can be disposed within a minimal amount of space defined within the remote hot melt adhesive metering station, wherein each one of the rotary, gear-type metering pumps can be independently installed within and removed from the remote hot melt adhesive metering station, and wherein further, the remote metering station can be fluidically connected to the applicator heads or dispensing nozzles by means of relatively short hose structures. In this manner, predeterminedly desired pressure levels, and precisely metered or predetermined volumes of the hot melt adhesive material, can be attained and maintained such that precisely metered or predetermined volumes of hot melt adhesive material can in fact be dispensed onto predetermined substrate locations.

SUMMARY OF THE INVENTION

The foregoing and other objectives are achieved in accordance with the teachings and principles of the present invention through the provision of a new and improved remote hot melt adhesive metering station for supplying predetermined or precisely metered volumes of hot melt adhesive material toward applicator head or dispensing nozzle structures. The new and improved remote hot melt adhesive metering station comprises a plurality of rotary, gear-type metering pumps which are arranged in a compact, longitudinally spaced manner upon a drive gear manifold such that the rotational axes of the plurality of rotary, gear-type metering pumps are disposed parallel and adjacent to one side of the drive gear manifold. Hot melt adhesive material is supplied from a remotely located adhesive supply unit (ASU), to the drive gear manifold, by means of an input hose connection or inlet supply port, and all of the pump driven gears of the plurality of rotary, gear-type metering pumps are respectively driven by means of manifold pump drive gears which are all rotatably mounted upon a common motor-driven drive shaft rotatably disposed within the drive gear manifold. The drive gear manifold is also provided with a plurality of outlet hose connections or outlet delivery ports to which hot melt adhesive delivery hoses are to be connected so as to respectively conduct or convey the precisely metered amounts of the hot melt adhesive material, outputted by means of the plurality of rotary, gear-type metering pumps mounted upon the drive gear manifold, toward the applicator heads or dispensing nozzles. In this manner, predeterminedly desired pressure levels, and precisely metered or predetermined volumes of the hot melt adhesive material, can be attained and maintained such that precisely metered or predetermined volumes of hot melt adhesive material can in fact be dispensed onto predetermined substrate locations.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein:

FIG. 2, are disposed atop the gear pump manifold;

DETAILED DESCRIPTION OF THE PREFERRED EMBODIMENT

Figure 1:
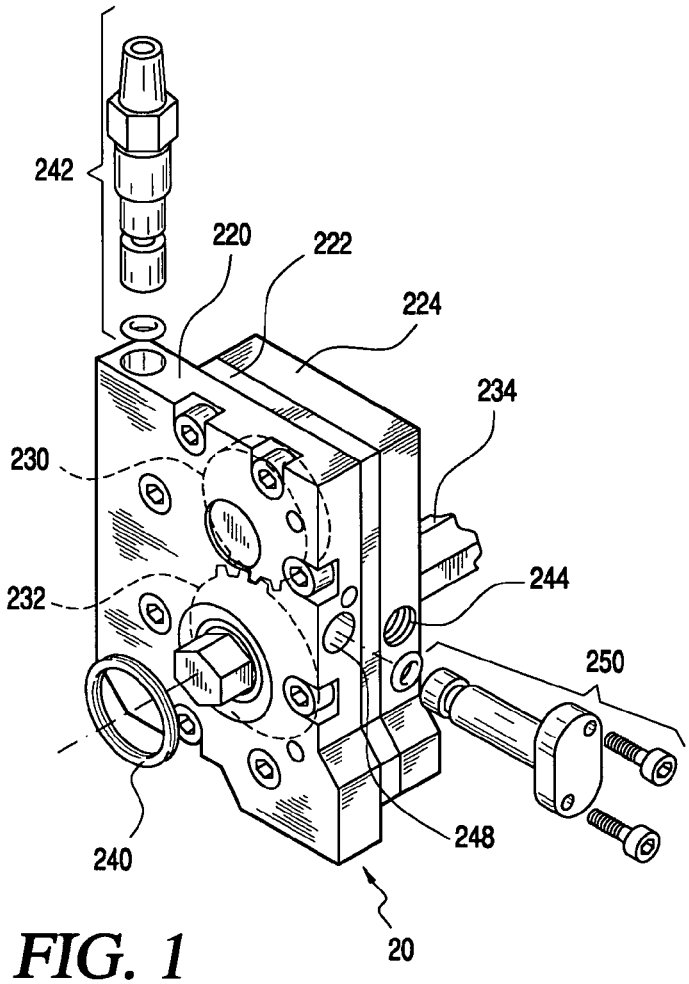
FIG. 1 (PRIOR ART)
FIG. 1 is a partially exploded perspective view of a conventional PRIOR ART gear pump assembly.
Figure 2:
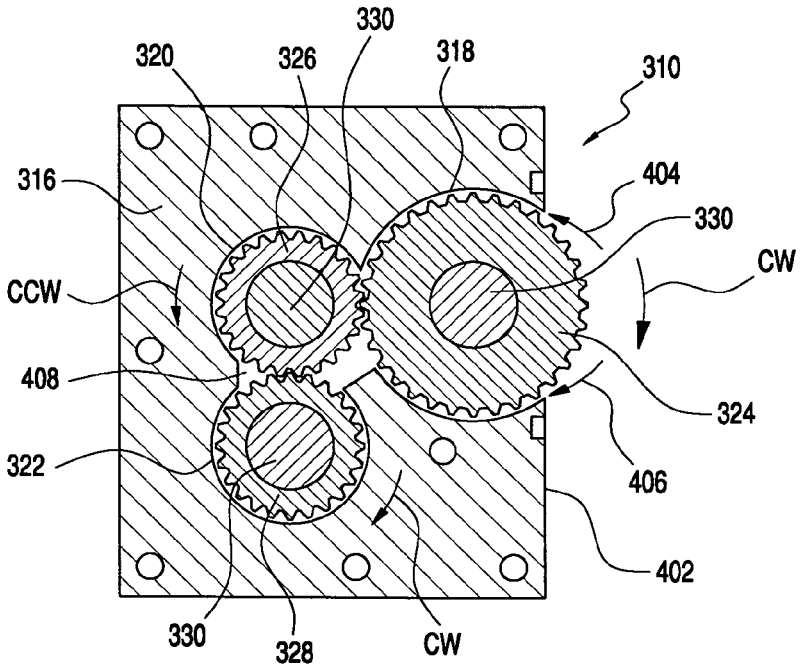
FIG. 2 is a cross-sectional view of a rotary, gear-type metering pump assembly, as disclosed within U.S. Pat. No. 6,688,498, which is of the type to be utilized within the remote hot melt adhesive metering station which has been constructed in accordance with the principles and teachings of the present invention.
Figure 3:
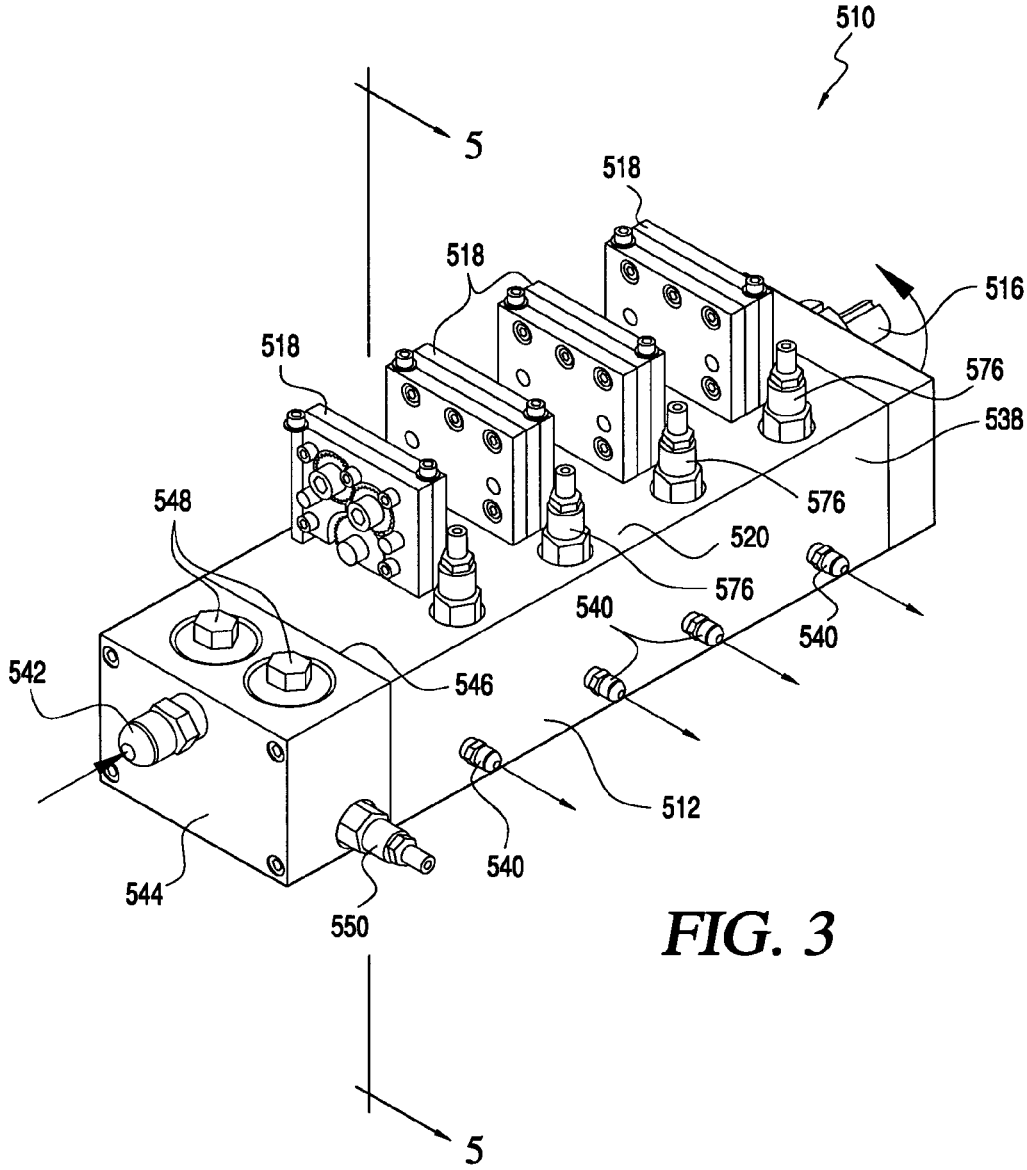
FIG. 3 is a perspective view of the new and improved remote hot melt adhesive metering station constructed in accordance with the principles and teachings of the present invention, and showing the cooperative parts thereof, wherein a plurality of rotary, gear-type metering pump assemblies, similar to the rotary, gear-type metering pump as disclosed within
Figure 4:
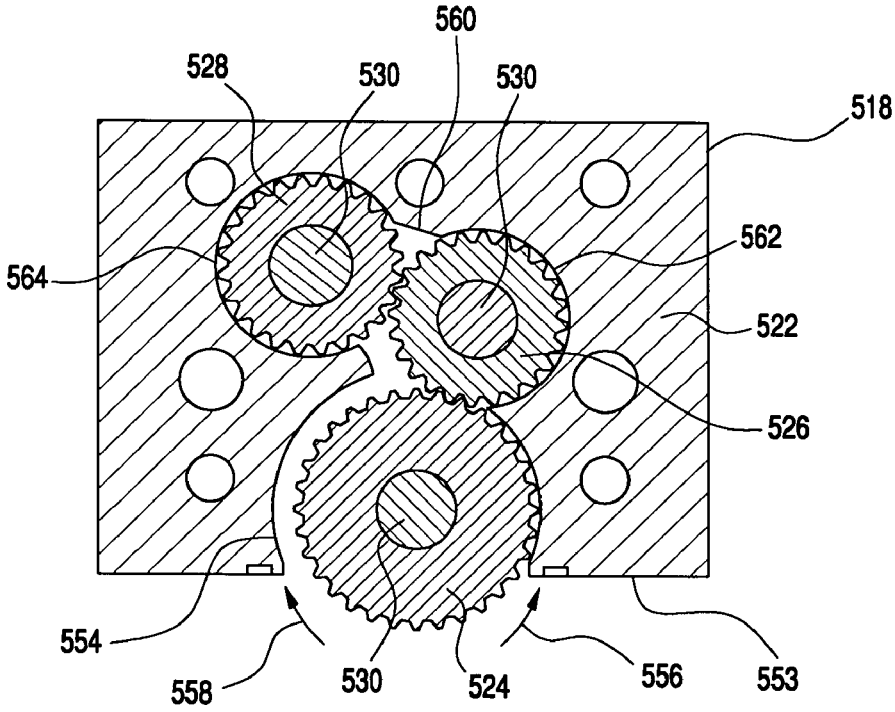
FIG. 4 is a cross-sectional view of one of the rotary, gear-type metering pump assemblies, which is substantially identical to the rotary, gear-type metering pump assembly as disclosed within FIG. 2, and which is adapted to be disposed within the new and improved remote hot melt adhesive metering station, as constructed in accordance with the principles and teachings of the present invention, and as has been disclosed within FIG. 3, wherein it is noted, however, that the rotary, gear-type metering pump assembly, as is disclosed within FIG. 4, has effectively been rotated 90° in the clockwise direction from the orientation of the rotary, gear-type metering pump assembly as disclosed within FIG. 2.
Figure 5:
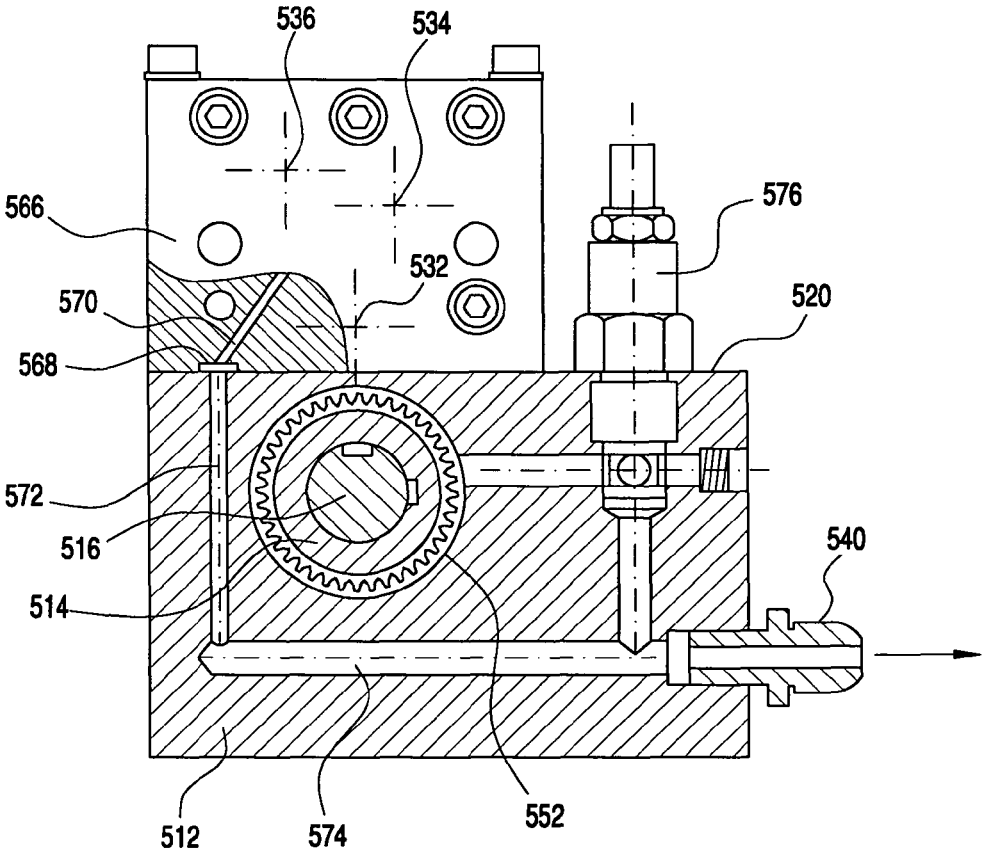
FIG. 5 is a cross-sectional view of the new and improved remote hot melt adhesive metering station as disclosed within FIG. 3 and as taken along the lines 5-5 of FIG. 3.

Referring now to the drawings, and more particularly to FIGS. 3-5 thereof, a new and improved remote hot melt adhesive metering station, constructed in accordance with the principles and teachings of the present invention, is illustrated so as to show the cooperative parts thereof, and is generally indicated by the reference character 510. More particularly, it is seen that the new and improved remote hot melt adhesive metering station, constructed in accordance with the principles and teachings of the present invention, is seen to comprise an axially elongated drive gear manifold 512 wherein a plurality of manifold pump drive gears, only one of which is shown at 514 within FIG. 5, are disposed internally within the axially elongated drive gear manifold 512. The plurality of manifold pump drive gears 514 are mounted in an axially spaced manner upon a common drive shaft 516 which extends axially through the drive gear manifold 512, and a plurality of rotary, gear-type metering pump assemblies 518 are mounted in an axially spaced manner upon an upper side wall portion 520 of the axially elongated drive gear manifold 512. As can best be seen from FIG. 4, each one of the rotary, gear-type metering pump assemblies 518 is substantially identical to the rotary, gear-type metering pump assembly 310 as disclosed within FIG. 2 except for the fact that the rotary, gear-type metering pump assembly 310 of FIG. 2 has effectively been rotated 90° in the clockwise direction so as to effectively define the rotary, gear-type metering pump assembly 518. Accordingly, it is to be appreciated that, as was the case with the rotary, gear-type metering pump assembly 310, each one of the rotary, gear-type metering pump assemblies 518 comprises a sandwiched housing structure which includes a central or intermediate plate 522 upon or within which a plurality of gears 524,526,528 are rotatably mounted in a substantially coplanar manner upon axially oriented shafts 530.

More particularly, gear member 524 comprises a pump driven gear, gear member 526 comprises a pump drive gear that is operatively enmeshed with the pump driven gear 524, and gear member 528 comprises a pump idler gear which is operatively enmeshed with the pump drive gear 526. In view of the fact that each one of the rotary, gear-type metering pump assemblies 518 as disclosed within FIG. 4 is substantially identical to the rotary, gear-type metering pump assembly 310 as disclosed within FIG. 2, a detailed description of the rotary, gear-type metering pump assembly 518 will be omitted herefrom for brevity purposes except for any description that is of course pertinent for the purposes of disclosure and understanding of the new and improved remote, hot melt adhesive metering station 510 which has been constructed in accordance with the principles and teachings of the present invention. Accordingly, it can be further appreciated that, as was the case with the rotary, gear-type metering pump assembly 310 as disclosed within FIG. 2, the plurality of rotary, gear-type metering pump assemblies 518, as mounted atop the axially elongated drive gear manifold 512, are axially spaced predetermined distances from each other such that the pump driven gears 524 of the plurality of rotary, gear-type metering pump assemblies 518 can be respectively disposed in enmeshed engagement with the axially spaced manifold pump drive gears 514 disposed within the axially elongated drive gear manifold 512. It is further seen that the axes 532, 534,536 of the pump driven gear 524, the pump drive gear 526, and the pump idler gear 528 are disposed parallel and adjacent to the upper side surface portion 520 of the axially elongated drive gear manifold 512.

Still further, as can be appreciated from FIGS. 3 and 5, the axially oriented common drive shaft 516 is adapted to be driven, through means of a suitable coupling mechanism, by means of a suitable drive motor and gearbox assembly, not shown but fully disclosed and illustrated within the aforenoted patent to McGuffey, and a plurality of gear pump, torque-overload release clutch mechanisms, which are also not shown but are likewise fully disclosed within the aforenoted patent to McGuffey, are mounted upon the common, axially oriented drive shaft 516 at predetermined axially spaced positions thereof so as to respectively drivingly engage the plurality of pump drive gears 514. More particularly, as is disclosed within the aforenoted patent to McGuffey, the axially oriented drive shaft 516 is provided with a plurality of key members which are fixedly mounted thereon at predetermined axially spaced positions for respectively operatively engaging a plurality of keyways which are defined within each one of the gear pump, torque-overload release clutch mechanisms so as to effectively define a drive connection therebetween. The provision of the rotary drive shaft 516, the key members, the gear pump, torque-overload release clutch mechanisms, and the manifold pump drive gears 514 within the axially elongated drive gear manifold 512 enables any one of the plurality of rotary, gear-type pump assemblies 518 to be independently engaged with, and disengaged from, its respective one of the plurality of manifold pump drive gears 514 without adversely affecting the operation of the other ones of the rotary, gear-type pump assemblies 518.

Continuing further, and with reference continuing to be made to FIGS. 3-5, a side wall portion 538 of the axially elongated drive gear manifold 512 is provided with a plurality of outlet port hose connections 540 to which suitable conveyance hoses, not shown, are adapted to be connected in order to transmit, transport, or convey the precisely metered liquid or hot melt adhesive material to suitable applicator head or dispensing mechanisms, and the liquid or hot melt adhesive material to be dispensed through the plurality of outlet port hose connections 540 is initially introduced into the axially elongated drive gear manifold 512 through means of a liquid inlet supply port 542 which is fixedly mounted upon a filter block 544 which, in turn, is fixedly mounted upon an end wall portion 546 of the axially elongated drive gear manifold 512. At least one filter assembly 548 is also mounted upon the filter block 544 for filtering the incoming liquid or hot melt adhesive material, and a pressure relief mechanism 550 is likewise mounted upon the filter block 544 for operative cooperation with the liquid inlet support port 542 and the at least one filter assembly 548 so as to maintain the pressure level within the incoming or supplied liquid or hot melt adhesive material at a predetermined pressure level. The liquid inlet supply port 542 is fluidically connected, through means of the one or more filter assemblies 548, to each one of a plurality of liquid supply cavities 552 which are defined within the axially elongated drive gear manifold 512 and which annularly surround each one of the manifold pump drive gears 514, as can best be seen in FIG. 5, and each one of the liquid supply cavities 552 is, in turn, respectively fluidically connected to a liquid accumulator cavity, not illustrated for clarity purposes, which is located adjacent to the enmeshed interface defined between each one of the manifold pump drive gears 514 and a respective one of the pump driven gears 524.

As has been previously described in connection with the rotary, gear-type pump assembly 310 disclosed within FIG. 2, and as can best be seen from FIG. 4, while a first arcuate portion of each one of the pump driven gears 524 is drivingly enmeshed with a respective one of the pump drive gears 526, a second arcuate portion of each pump driven gear 524 projects radially outwardly through an end face 553 of the central or intermediate plate 522 of each one of the rotary, gear-type pump assemblies 518 so as to be drivingly enmeshed with a respective one of the manifold pump drive gears 514. Accordingly, as the drive motor and gearbox assembly, not shown, causes rotation of the axially oriented common drive shaft 516, and therefore each manifold pump drive gear 514 in, for example, the counterclockwise direction, the pump driven gear 524 of each one of the gear pump assemblies 518 is driven in the clockwise direction, the pump drive gear 526 is driven in the counterclockwise direction, and the pump idler gear 528 is driven in the clockwise direction. As can additionally be best seen from FIG. 4, the diametrical extent of the cutout region 554 defined within the central or intermediate plate 522 of each one of the gear pump assemblies 518 is substantially larger than the diametrical extent of the pump driven gear 524 of each one of the gear pump assemblies 518. Accordingly, when the liquid, which is to be pumped through each one of the gear pump assemblies 518, and ultimately dispensed from a respective one of the outlet port hose connections 540, is supplied to each one of the liquid supply cavities 552 and each liquid accumulator cavity, not designated by a reference character for clarity purposes, oppositely oriented liquid flow paths 556,558 are effectively defined between the inner peripheral wall of the cutout region 554 and the outer periphery of the pump driven gear 524 despite the fact that the pump driven gear 524 is being driven in the clockwise direction. Subsequently, the liquid portions, originally flowing along the flow paths 556, 558, are respectively entrained by means of the pump drive gear 526 and the pump idler gear 528 and are conducted toward a common liquid inlet cavity 560 which is effectively formed at the interface defined between the cutout regions 562,564 formed within the central or intermediate plate 522 as may best be appreciated from FIG. 4.

With reference therefore now being additionally made again to FIG. 5, in conjunction with each one of the aforenoted common liquid inlet cavities 560 which are effectively formed at the interfaces defined between the cutout regions 562,564 formed within each one of the central or intermediate plates 522 of each one of the gear pump assemblies 518, a liquid outlet cavity, not illustrated but disclosed within the aforenoted patent to McGuffey, is formed within one of the side plates 566 of each one of the gear pump assemblies 518 so as to be in fluidic communication with its respective one of the common liquid inlet cavities 560. A pump outlet port 568 is defined within a lower portion of the side plate 566 of each one of the gear pump assemblies 518, as best seen in FIG. 5, and a fluid passageway 570, internally defined within the side plate 566, fluidically connects the liquid outlet cavity, not shown, to the pump outlet port 568. As can be further appreciated from FIG. 5, once a metered flow of the hot melt adhesive material is outputted through means of the pump outlet port 568 of each one of the gear pump assemblies 518, the hot melt adhesive material is conducted through a first vertically oriented fluid passageway 572, which extends vertically within the axially elongated drive gear manifold 512, and a second fluid passageway 574 which extends horizontally within the axially elongated drive gear manifold 512 so as to be fluidically connected to a respective one of the output port hose connections 540. As was the case in connection with the filter block 544 and the pressure relief mechanism 550 mounted thereon, it is lastly noted that a plurality of upstanding pressure relief mechanisms 576 are respectively mounted within the upper end portion of the axially elongated drive gear manifold 512 so as to operatively cooperate with the second fluid passageway 574 in order to maintain the pressure level within the outputted hot melt adhesive material at a predetermined pressure level.

Thus, it may be seen that in accordance with the present invention, there has been provided a new and improved remote hot melt adhesive metering station for supplying predetermined or precisely metered volumes of hot melt adhesive material toward applicator head or dispensing nozzle structures. The new and improved remote hot melt adhesive metering station comprises a plurality of rotary, gear-type metering pumps which are arranged in a compact, longitudinally spaced manner upon an axially elongated drive gear manifold such that the rotational axes of the plurality of rotary, gear-type metering pumps are disposed parallel and adjacent to one side of the axially elongated drive gear manifold. Hot melt adhesive material is supplied from a remotely located adhesive supply unit (ASU), to the axially elongated drive gear manifold, by means of an input hose connection or inlet supply port, and all of the pump driven gears of the plurality of rotary, gear-type metering pumps are respectively driven by means of manifold pump drive gears which are all rotatably mounted upon a common, motor-driven drive shaft rotatably disposed within the drive gear manifold. The drive gear manifold is also provided with a plurality of outlet port hose connections to which hot melt adhesive delivery hoses are to be connected so as to respectively conduct or convey the precisely metered amounts of the hot melt adhesive material, outputted by means of the plurality of rotary, gear-type metering pumps mounted upon the drive gear manifold, toward the applicator heads or dispensing nozzles. In this manner, predeterminedly desired pressure levels, and precisely metered or predetermined volumes of the hot melt adhesive material, can be attained and maintained such that precisely metered or predetermined volumes of hot melt adhesive material can in fact be dispensed onto predetermined substrate locations.

Obviously, many variations and modifications of the present invention are possible in light of the above teachings. It is therefore to be understood that within the scope of the appended claims, the present invention may be practiced otherwise than as specifically described herein.

What is claimed as new desired to be protected by Letters Patent of the United States of America, is:

1. A remote, hot melt adhesive metering station, comprising:

an axially oriented drive gear manifold having a longitudinal extent extending along a longitudinal axis, an end wall, a top wall, and a side wall;

a multitude of manifold pump drive gears rotatably disposed internally within said axially oriented drive gear manifold so as to be disposed at predetermined axially spaced positions within said axially oriented drive gear manifold along said longitudinal axis;

a hot melt adhesive inlet supply port defined within said end wall of said drive gear manifold for supplying pressurized hot melt adhesive to said multitude of manifold pump drive gears;

a multitude of rotary, gear-type metering pump assemblies mounted upon said top wall of said drive gear manifold, at predetermined axially spaced positions along said top wall of said drive gear manifold, wherein each one of said rotary, gear-type metering pump assemblies comprises a pump driven gear having a peripheral portion thereof extending radially downwardly out from its rotary, gear-type metering pump assembly so as to be respectively disposed in enmeshed engagement with one of said multitude of manifold pump drive gears rotatably disposed within said drive gear manifold such that each one of said rotary, gear-type metering pump assemblies outputs a precisely metered amount of hot melt adhesive material;

a multitude of outlet port hose connections, to which conveyance hoses can respectively be operatively connected, mounted upon said top wall of said drive gear manifold of said metering station, at predetermined axially spaced positions along said side wall of said drive gear manifold, for permitting said precisely metered amounts of the hot melt adhesive material, respectively supplied directly to said multitude of outlet port hose connections by said multitude of rotary, gear-type metering pump assemblies of said metering station, to be dispensed by said metering station toward remote hot melt adhesive applicators by the conveyance hoses which are respectively operatively connected to said multitude of outlet port hose connections of said metering station; and a multitude of fluid flow paths defined within said multitude of rotary, gear-type metering pump assemblies mounted upon said top wall of said drive gear manifold, and within said drive gear manifold for respectively fluidically connecting said outputs of said multitude of rotary, gear-type metering pump assemblies to said multitude of outlet port hose connections.

2. The remote, hot melt adhesive metering station as set forth in claim 1, wherein:

said multitude of manifold pump drive gears rotatably disposed within said drive gear manifold comprises a plurality of coaxially disposed manifold pump drive gears;

said multitude of rotary, gear-type metering pump assemblies mounted upon said drive gear manifold comprises a plurality of rotary, gear-type metering pump assemblies which respectively comprise pump driven gears disposed in enmeshed engagement with said plurality of coaxially disposed manifold pump drive gears rotatably disposed within said drive gear manifold; and said at least one outlet port comprises a plurality of outlet ports respectively fluidically connected to said plurality of rotary, gear-type metering pump assemblies.

3. The remote, hot melt adhesive metering station as set forth in claim 2, wherein:

said plurality of coaxially disposed manifold pump drive gears are rotatably mounted upon a common rotary drive shaft; and said plurality of rotary, gear-type metering pump assemblies are disposed within a linear array atop said drive gear manifold.

4. The remote, hot melt adhesive metering station as set forth in claim 3, wherein each one of said plurality of rotary, gear-type metering pump assemblies comprises:

a gear pump housing; and a pump drive gear disposed in enmeshed engagement with said pump driven gear, wherein each one of said pump driven gears has a first arcuate portion which is disposed internally within said gear pump housing and which is disposed in enmeshed engagement with said pump drive gear for driving said pump drive gear, and a second arcuate portion which projects externally outwardly from said gear pump housing for enmeshed engagement with said manifold pump drive gear of said drive gear manifold.

5. The remote, hot melt adhesive metering station as set forth in claim 4, wherein:

each one of said gear pump housings comprises a pair of side plates and an intermediate plate;

said intermediate plate has a plurality of cut-out regions defined therein; and said pump drive gear and said pump driven gear are rotatably disposed within said cut-out regions defined within said intermediate plate such that said pump drive gear and said pump driven gear are disposed in a substantially coplanar manner with respect to said intermediate plate.

6. The remote, hot melt adhesive metering station as set forth in claim 5, wherein:

each one of said pump driven gears and each one of said pump drive gears is rotatably mounted within said gear pump housing upon a rotary shaft disposed entirely within said gear pump housing such that opposite ends of said rotary shafts are rotatably mounted upon internal surface portions of said side plates of said gear pump housing so as not to extend through said side plates of said gear pump housing whereby rotary dynamic shaft seals, for said pump drive gear and said pump driven gear shafts, are not required to be provided upon said gear pump housing.

7. The liquid metering pump assembly and integral reservoir tank structure as set forth in claim 5, further comprising:

a gear pump inlet defined within said intermediate plate; and a gear pump outlet defined within one of said side plates.

8. The remote, hot melt adhesive metering station as set forth in claim 7, further comprising:

a pump idler gear enmeshed with said pump drive gear so as to be driven by said pump drive gear;

a pair of liquid inlet flow paths, defined between said pump driven gear and one of said cut-out regions defined within said intermediate plate, for conducting the liquid, to be dispensed, toward said pump drive gear and said pump idler gear;

a common liquid inlet cavity, defined within said intermediate plate, for receiving liquid from both said pump drive gear and said pump idler gear; and a fluid passageway defined within said one of said side plates and fluidically connected to said common liquid inlet cavity and to said gear pump outlet so as to transmit the liquid, to be dispensed, to said gear pump outlet.

9. The remote, hot melt adhesive metering station as set forth in claim 4, wherein:

said second arcuate portion of said pump driven gear projects outwardly from an end face of said intermediate plate so as to project outwardly from an end surface portion of said gear pump housing whereby said plurality of gear pump assemblies are able to be disposed in a side-by-side arrangement.

10. The remote, hot melt adhesive metering station as set forth in claim 9, wherein:

said second arcuate portion of each one of said pump driven gears projects outwardly from an end surface portion of each one of said gear pump housings so as to be respectively independently engageable with and disengageable from said drive gear manifold as a result of being respectively independently engageable with and disengageable from each one of said plurality of manifold pump drive gears mounted upon said common rotary drive shaft.

11. The remote, hot melt adhesive metering station as set forth in claim 10, further comprising:

a plurality of torque-overload release clutch mechanisms fixedly mounted upon said common rotary drive shaft and respectively operatively engaged with said plurality of manifold pump drive gears mounted upon said common rotary drive shaft for independently imparting rotational drive to said plurality of manifold pump drive gears mounted upon said common rotary drive shaft in a torque-overload release manner whereby if a particular one of said plurality of gear pump assemblies experiences an operational failure, remaining ones of said plurality of gear pump assemblies can continue to operate.

12. The remote, hot melt adhesive metering station as set forth in claim 4, wherein:

each one of said pump drive gears and each one of said pump driven gears is rotatable about an axis which is disposed parallel and adjacent to a side wall member of said drive gear manifold.

* * * * *